US005591044A

United States Patent [19]

Abe et al.

[11] Patent Number: 5,591,044

[45] Date of Patent: Jan. 7, 1997

[54] PRESS-CONNECTING TERMINAL

[75] Inventors: Kimihiro Abe; Katsuhiko Onoda, both of Shizuoka, Japan

[73] Assignee: Yazaki Corporation, Tokyo, Japan

[21] Appl. No.: 568,800

[22] Filed: Dec. 7, 1995

[30] Foreign Application Priority Data

Dec. 8, 1994 [JP] Japan ..... 6-305075

[51] Int. Cl.[6] ..... H01R 4/24

[52] U.S. Cl. ..... 439/397

[58] Field of Search ..... 439/397, 399, 439/400, 395

[56] References Cited

U.S. PATENT DOCUMENTS 4,973,261 11/1990 Hatagishi et al. ..... 439/397
5,380,218 1/1995 Yamamoto et al. ..... 439/397
5,427,545 6/1995 Koorimsky et al. ..... 439/397
5,458,502 10/1995 Joly ..... 439/397

*Primary Examiner*—Neil Abrams
*Assistant Examiner*—Christopher Goins
*Attorney, Agent, or Firm*—Sughrue, Mion, Zinn, Macpeak & Seas

[57] ABSTRACT

Opposed plate portions are spaced a predetermined distance from each other to form a press-connecting blade, and deformation prevention piece portions of an L-shaped horizontal cross-section are provided beneath the plate portions to support the same from the lower side. With this construction, there is achieved a press-connecting portion of a press-connecting terminal, in which the plate portions of are prevented from being deformed away from each other when a wire is press-fitted into the press-connecting blade.

2 Claims, 4 Drawing Sheets

PRESS-CONNECTING TERMINAL

BACKGROUND OF THE INVENTION

1. Field of the Invention

This invention relates to a press-connecting terminal having press-connecting blades into which a wire is press-fitted to be electrically connected thereto, and more particularly to a press-connecting terminal in which the press-connecting blade is prevented from deformation when the wire is press-fitted into this blade.

2. Related art

Usually, sensors and electronic devices for various controls are mounted on an automobile, and the sensors are connected to the electronic devices through an automobile wire harness. Therefore, the number of connections between the electronic devices and wires, as well as the number of connections between the wires, is naturally large. Therefore, in order to enhance the efficiency of assembling of the automobile and also to facilitate the disassembling and assembling for maintenance purposes, press-connecting connectors capable of easily connecting the wires together are commonly used. Press-connecting terminals each having a press-connecting blade are attached to the press-connecting connector, and then the wire is press-fitted in the press-connecting terminal.

One conventional press-connecting terminal for use in such a press-connecting connector, as disclosed in U.S. Pat. No. 4,385,794, will now be described. As shown in FIG. 9, the press-connecting terminal 1 is formed by blanking and bending an electrically-conductive metal sheet. This terminal 1 has a press-connecting portion 2 of a U-shaped transverse cross-section formed at a generally central portion thereof in its longitudinal direction. A clamping portion 3 for clamping and holding a wire is provided at one end of the terminal while a connection portion 4 for connection to a mating terminal is provided at the other end of the terminal.

More specifically, slit-like press-connecting blades 5*a* and 5*b* are provided at front and rear ends of the press-connecting portion 2, respectively. For connecting the wire, the sheathed wire is press-fitted into the press-connecting portion in a direction of arrow A, so that the press-connecting blades 5*a* and 5*b* cut the wire sheath to be electrically connected to the wire. The thus connected wire is clamped by the clamping portion 3 against disengagement. The mating terminal is inserted into an open portion 4*a* of the connection portion 4, and is electrically connected to a resilient contact piece portion 4*b*.

Another press-connecting terminal (different from the above terminal) as disclosed in Japanese Utility Model Unexamined Publication No. 60-142463 will now be described with reference to FIGS. 10 and 11.

As shown in FIG. 10, this press-connecting terminal 11 is formed by blanking and bending an electrically-conductive metal sheet. This terminal 11 has a press-connecting portion 12 formed at a generally central portion thereof in its longitudinal direction. A clamping portion 13 for clamping and holding a wire is provided at one end of the terminal while a connection portion 14 for connection to a mating terminal is provided at the other end of the terminal.

More specifically, the press-connecting portion 12 includes a bottom plate 12*a*, opposite side plates 12*b* bent upright respectively along opposite sides of the bottom plate 12*a*, and a pair of opposed sheet-like contact piece portions 15 which are formed by stamping and bending front and rear portions of the bottom plate 12*a*, upright, with the central portion of the bottom plate 12*a*, remaining intact. Each sheet-like contact piece portion 15 has a contact slot 16 open to its upper edge. The two sheet-like contact piece portions 15 and the central portion 12*a*, of the bottom plate, continuous therewith, jointly assume a cross-sectionally U-shape. A pair of tabs 17, formed respectively on opposite sides of each sheet-like contact piece portion 15 at an upper portion thereof, are engaged respectively in notches 18 formed respectively in the opposite side plates 12*b* and 12*b*, thereby preventing the contact piece portion 15 from falling in the longitudinal direction.

For connecting the wire 19, the sheathed wire 19 is press-fitted into the contact slots 16, so that edges of the contact slots cut the wire sheath to contact a conductor 20 of the wire, as shown in FIG. 11.

In the construction of the above press-connecting terminal 1, during the time when the wire is press-fitted into the press-connecting portion 2, there develops a force tending to expand or open the whole of the press-connecting portion 2 as the press-connecting blades 5*a* and 5*b* cut the wire sheath. If this occurs, the contact of the press-connecting blades 5*a* and 5*b* with the conductor is incomplete, and therefore a plurality of recesses 6 are formed in the bent portion by a punch or the like, thereby preventing the expansion of the press-connecting portion 2. However, such expansion can not be sufficiently prevented only by the recesses 6, thus inviting a problem that upon application of a large force, the press-connecting portion 2 is expanded or opened.

In the construction of the above press-connecting terminal 11, the opposite side plates 12*b* are bent upright to form, together with the bottom plate, the U-shaped cross-sectional configuration to support the tabs 17, thereby preventing the expansion or opening of the contact piece portion 15 (having the contact slot 16) in directions B upon press-fitting of the wire.

If the press-connecting terminal 11 is designed into a small size, or if a wire of a large diameter is press-fitted into the press-connecting terminal 11 without increasing the size of this terminal, it is necessary to reduce a width W1 of a half portion of the contact piece portion 15. However, the thickness of the conductive metal sheet is about 2 mm at best, and if the overall width W0 of the press-connecting terminal 11 is 15 mm, and the width of the slit is 5 mm, then the width W1 is 2.5 mm, and a clearance is 0.5 mm. Therefore, the blanking formation becomes difficult. In the press-connecting terminal 11 of this construction, the compact design is limited by the width W1.

SUMMARY OF THE INVENTION

It is an object of this invention to provide a press-connecting terminal in which a press-connecting blade is prevented from being opened or deformed upon press-fitting of a wire, and a compact design can be suitably achieved.

The above object of the invention has been achieved by a press-connecting terminal having a press-connecting blade which can cut a sheath of a wire to be electrically connected to a conductor of the wire when the wire is press-fitted into the press-connecting blade, wherein the press-connecting blade is constituted by a pair of opposed plate portions spaced a predetermined distance from each other; a first deformation prevention piece portion, having an L-shaped horizontal cross-section, is formed below one of the two plate portions through a stepped portion formed at a lower end of the one plate portion; a second deformation prevention piece portion, having an L-shaped horizontal cross-section, is formed at a lower end of the other of the two plate portions; the first deformation prevention piece portion is received in a second notch, formed below the other plate portion, to support part of the other plate portion from a lower side thereof; and the second deformation prevention piece portion is received in a space, disposed outwardly of the stepped portion, and a first notch, formed below the one plate portion, to support part of the one plate portion from a lower side thereof over an area of an L-shaped horizontal cross-section, thereby preventing the two plate portions from being deformed away from each other when the wire is press-fitted into the press-connecting blade.

In the press-connecting terminal of the above construction, the first deformation prevention piece portion, having an L-shaped horizontal cross-section, is formed below one of the two plate portions through the stepped portion formed at the lower end of the one plate portion, and the second deformation prevention piece portion, having an L-shaped horizontal cross-section, is formed at the lower end of the other of the two plate portions, and the first deformation prevention piece portion is received in the second notch, formed below the other plate portion, to support part of the other plate portion from the lower side thereof, and the second deformation prevention piece portion is received in the space, disposed outwardly of the stepped portion, and the first notch, formed below the one plate portion, to support part of the one plate portion from the lower side thereof over the area of an L-shaped horizontal cross-section.

Thus, the deformation prevention piece portions of an L-shaped horizontal cross-section are provided beneath the opposed plate portions, spaced a predetermined distance from each other to constitute the press-connecting blade, to thereby support the plate portions from the lower side. With this construction, the two plate portions are positively prevented from being deformed away from each other when the wire is press-fitted into the press-connecting blade.

And besides, a sufficient strength for a relatively thick wire can be secured without increasing the thickness of the metal sheet, and by changing the bending positions depending on the diameter of the wire, the slot width can be changed, so that the press-connecting terminal can be of a compact construction.

DETAILED DESCRIPTION OF THE PREFERRED EMBODIMENTS

One preferred embodiment of a press-connecting terminal of the present invention will now be described in detail with reference to FIGS. 1 to 8.

Figure 1:
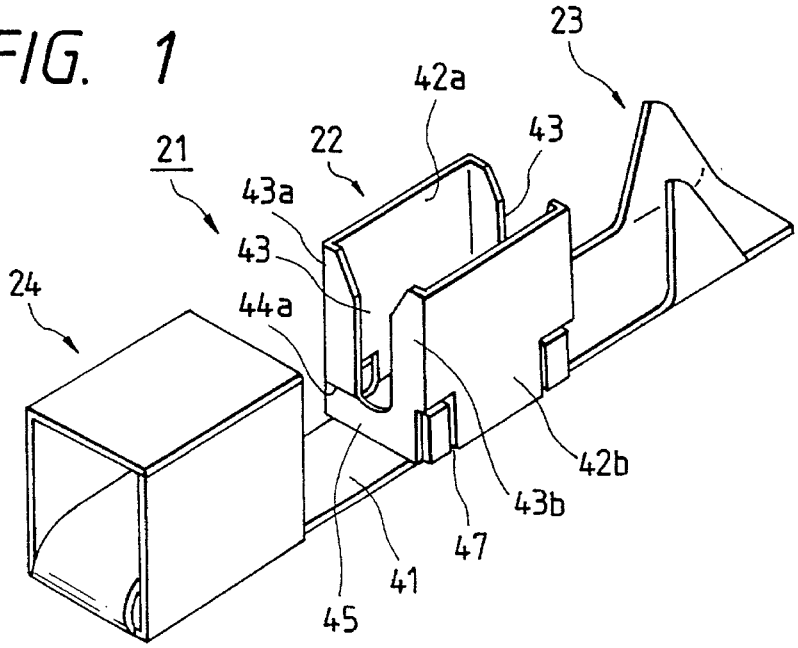
FIG. 1 is a perspective view of one preferred embodiment of a press-connecting terminal of the invention.
Figure 2:
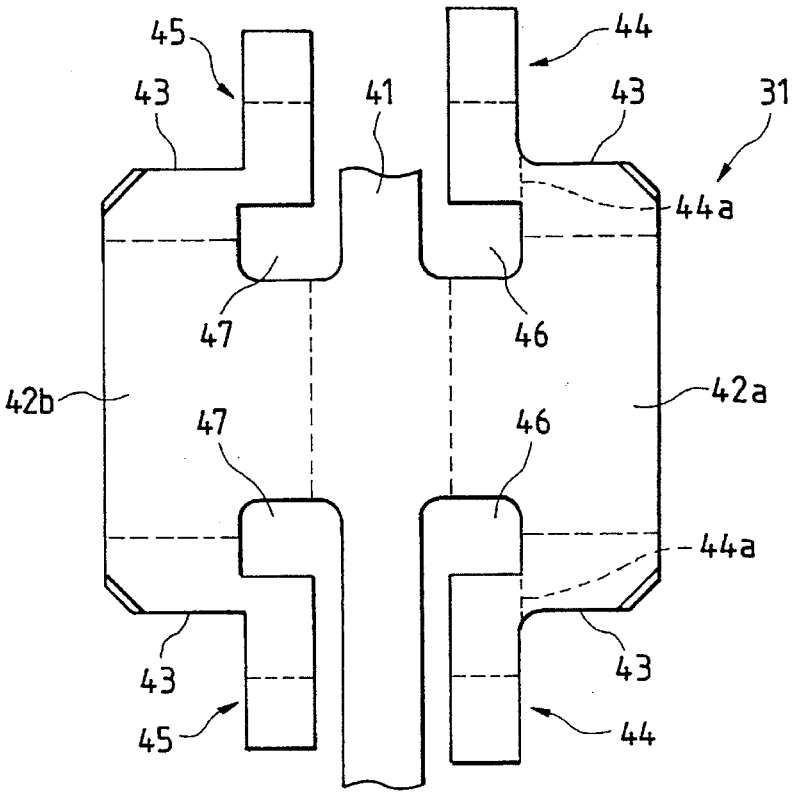
FIG. 2 is a developed view of the terminal of FIG. 1.

As shown in FIG. 1, the press-connecting terminal 21 includes a press-connecting portion 22 formed at a generally central portion thereof, and a clamping portion 23 for holding a wire and a connection portion 24 for contact with a mating terminal are integrally formed at rear and front ends of the terminal 21, respectively. The press-connecting terminal 21 is formed by blanking an electrically-conductive metal sheet 31 and then by bending it. FIG. 2 shows a developed configuration of the press-connecting portion 22. The blanked metal sheet is bent along broken lines in FIG. 2, and when assembled, a bottom plate portion 41, opposite side plate portions **42*a* and 42*b* and press-connecting blades 43 are provided as shown in FIG. 1**.

Therefore, means preventing the expansion or opening of the press-connecting portion 22 upon press-fitting of the wire is constituted by deformation prevention piece portions 44 and 45 and notches 46 and 47, and the two prevention means of the same construction are provided beneath the two (front and rear) press-connecting blades 43, respectively, and therefore one of these will be described below.

Figure 3:
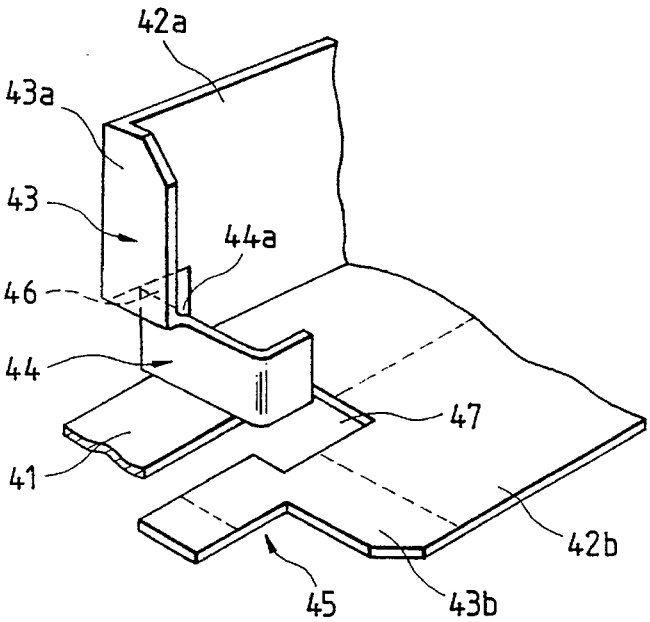
FIG. 3 is a perspective view of an important portion during a process of bending the press-connecting terminal.

As shown in FIG. 3, the side plate portion **42*a* is bent along the bottom plate portion 41, and the plate portion 43*a* constituting the press-connecting blade 43 is bent together with the first deformation prevention piece portion 44 in overlying relation to the bottom plate portion 41. A distal end of the first deformation prevention piece portion 44 is further bent to extend along the bottom plate portion 41. At this time, a stepped portion 44*a* is formed above the first deformation prevention piece portion 44, thus assuming a crank-shape. As a result, a space for receiving the other (second) prevention piece portion 45 is formed beneath the plate portion 43*a* (which constitutes the press-connecting blade 43) outwardly of the first deformation prevention piece portion 44**.

Figure 4:
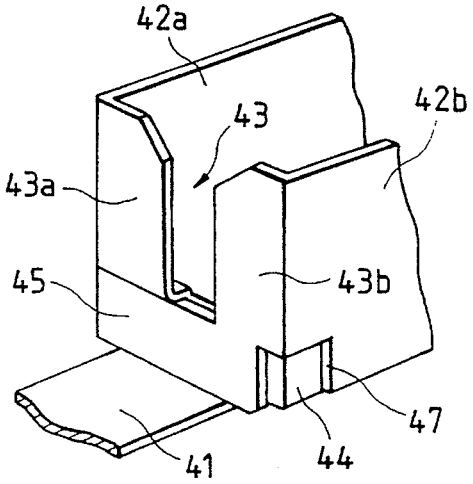
FIG. 4 is a perspective view of an important portion after the bending of the press-connecting terminal is completed.

Then, as shown in FIG. 4, the side plate portion **42*b* is bent along the bottom plate portion 41, and a plate portion 43*b* constituting the press-connecting blade 43 is bent together with the second deformation prevention piece portion 45 outwardly of the first deformation prevention piece portion 44 in overlying relation to the bottom plate portion 41. As a result, the second deformation prevention piece portion 45 overlaps the first deformation prevention piece portion 44, and is received in the space beneath the plate portion 43*a***, and assumes an L-shape when viewed from the upper side.

The distal end portion of the first deformation prevention piece portion 44 overlaps the side plate portion **42*b* in generally continuous relation thereto in the second notch 47, and the distal end portion of the second deformation prevention piece portion 45 is bent to be disposed in generally continuous relation to the side plate portion 42*a* in the first notch 46**.

Figure 5:
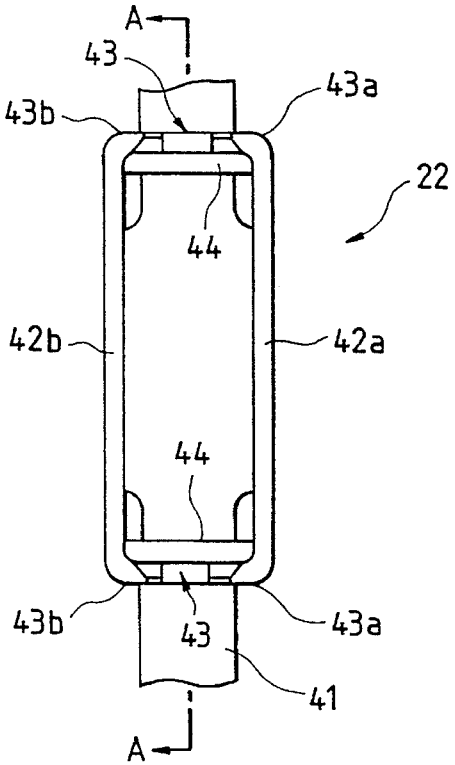
FIG. 5 is a plan view in the condition of FIG. 4.
Figure 6:
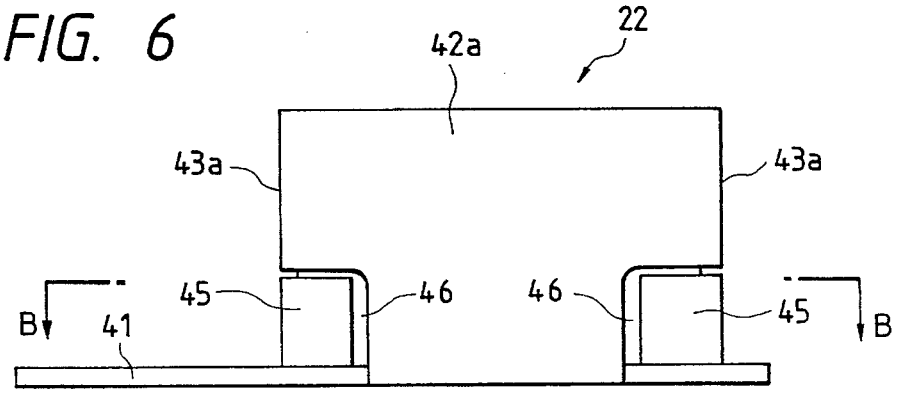
FIG. 6 is a side-elevational view in the condition of FIG. 4.

When this assembled condition is viewed from the upper side, the press-connecting portion 22 has a rectangular shape as shown in FIG. 5, and the wire can be press-fitted into the two press-connecting blades 43 to be electrically connected thereto. The distal end portion of the second deformation prevention piece portion 45 is disposed outwardly of the first deformation prevention piece portion 44, and is received in the first notch 46, as shown in FIG. 6.

Figure 7:
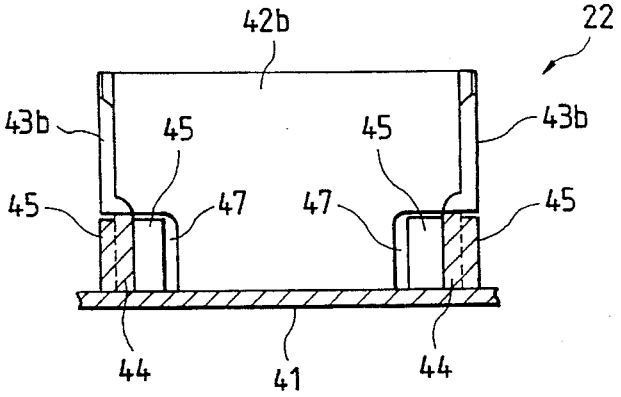
FIG. 7 is cross-sectional view taken along the line A—A of FIG. 5.

As shown in FIG. 7, the first and second deformation prevention piece portions 44 and 45 overlap each other in the direction of the width, and the second deformation prevention piece portion 45 is received in the space beneath the plate portion 43*a* to support the same from the lower side.

Figure 8:
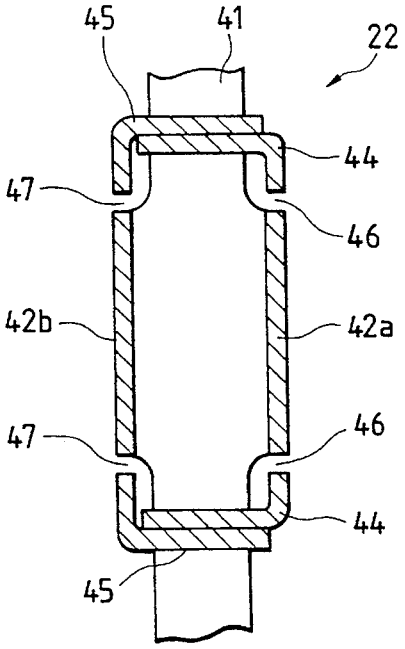
FIG. 8 is a cross-sectional view taken along the line B—B of FIG. 6.
Figure 9:
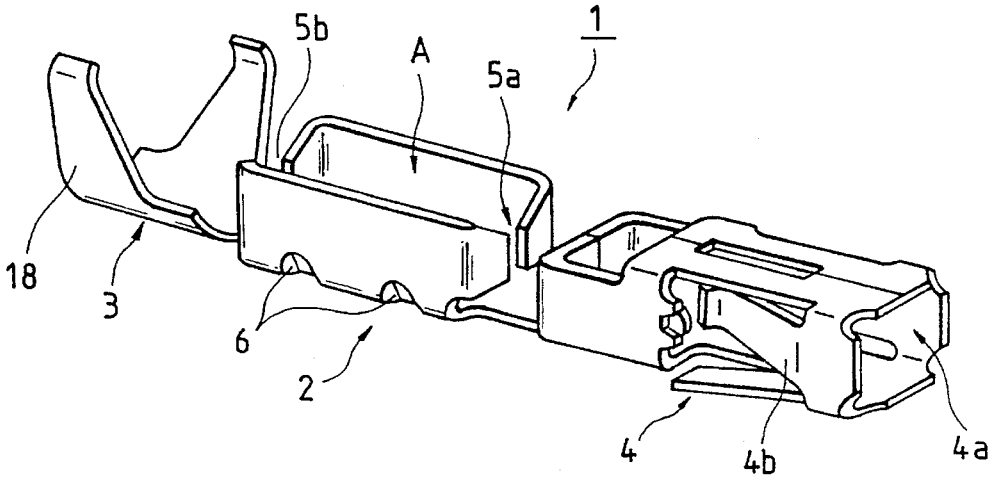
FIG. 9 is a perspective view of a conventional press-connecting terminal.
Figure 10:
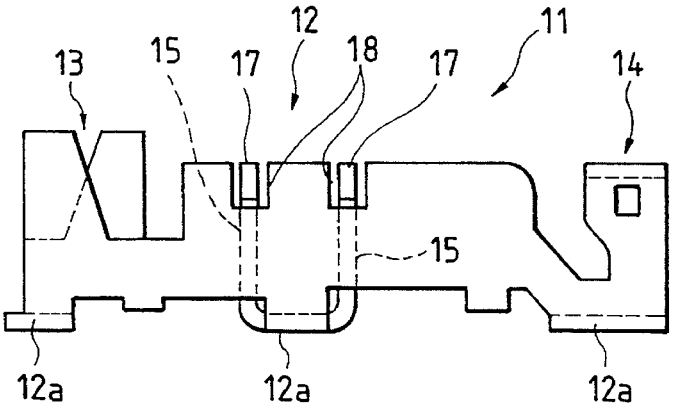
FIG. 10 is a perspective view of another conventional press-connecting terminal.
Figure 11:
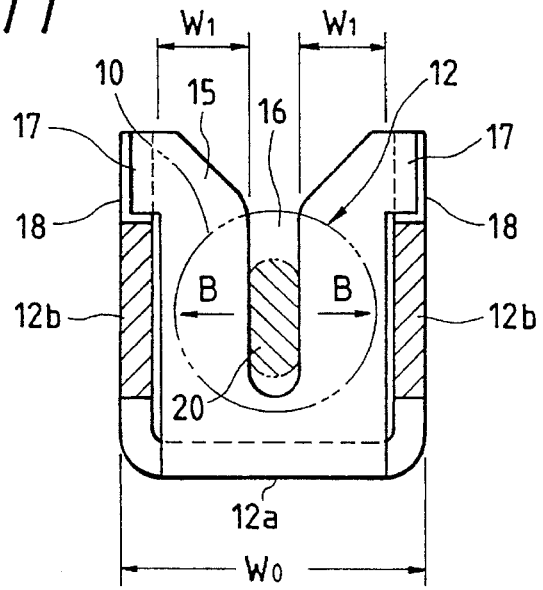
FIG. 11 is a cross-sectional view of an important portion of the terminal of FIG. 10.

As shown in FIG. 8, the distal end portions of the first and second deformation prevention piece portions 44 and 45 are received respectively in the second and first notches 47 and 46 to support the end portions of the side plate portions 42*b* and 42*a*. Namely, the side plate portions 42*a* and 42*b* are supported by the L-shaped portions from the lower side at four corners of the press-connecting portion 22.

Therefore, when the wire is press-fitted into the press-connecting blades 43 of the press-connecting portion 42 of the above construction, so that there develops a force tending to urge the two side plate portions 42*a* and 42*b* away form each other, the two side plate portions 42*a* and 42*b* will not be deformed away from each other, since the two side plate portions 42*a* and 42*b* are supported by the second and first deformation prevention piece portions 45 and 44 from the lower side. Therefore, the slot width of each press-connecting blade 43 is kept constant, so that the press-connecting blade 43 can cut the sheath of the wire to contact the conductor of the wire in a satisfactory manner.

The press-connecting terminal 21 of the above construction has a sufficient strength to satisfactorily receive the wire of a large diameter even if this terminal 21 is not formed of a thick metal sheet, and this terminal 21 can be of a more compact size than the conventional press-connecting connecting terminal designed to be connected to a wire of a large diameter. And besides, depending on the diameter of the wire to be used, the slot width can be changed by changing the bending positions, so that the press-connecting terminal of this construction can be compatible with wires of various diameters.

As described above, in the press-connecting terminal of the invention, the first deformation prevention piece portion, having an L-shaped horizontal cross-section, is formed below one of the two plate portions through the stepped portion formed at the lower end of the one plate portion, and the second deformation prevention piece portion, having an L-shaped horizontal cross-section, is formed at the lower end of the other of the two plate portions, and the first deformation prevention piece portion is received in the second notch, formed below the other plate portion, to support part of the other plate portion from the lower side thereof, and the second deformation prevention piece portion is received in the space, disposed outwardly of the stepped portion, and the first notch, formed below the one plate portion, to support part of the one plate portion from the lower side thereof over the area of an L-shaped horizontal cross-section.

Thus, the deformation prevention piece portions are provided beneath the opposed plate portions, spaced a predetermined distance from each other to constitute the press-connecting blade, to thereby support the plate portions from the lower side. With this construction, the two plate portions are positively prevented from being deformed away from each other when the wire is press-fitted into the press-connecting blade. Therefore, the press-connecting blade can be positively connected to the wire conductor, thus preventing an incomplete contact therebetween.

The press-connecting terminal has a sufficient strength to satisfactorily receive the wire of a large diameter even if this terminal is not formed of a thick metal sheet, and this terminal can be of a more compact size than the conventional press-connecting terminal designed to be connected to a wire of a large diameter.

And besides, depending on the diameter of the wire to be used, the slot width can be changed by changing the bending positions, so that the press-connecting terminal of this construction can be compatible with wires of various diameters.

What is claimed is:

1. A press-connecting terminal comprising:

a press-connecting blade cutting a sheath of a wire to be electrically connected to a conductor of the wire when the wire is press-fitted into said press-connecting blade, said press-connecting blade including:

a pair of opposed plate portions spaced a predetermined distance from each other;

a first deformation prevention piece portion, having an L-shaped horizontal cross-section, formed below one of said two plate portions through a stepped portion formed at a lower end of said one plate portion; and a second deformation prevention piece portion, having an L-shaped horizontal cross-section, formed at a lower end of the other of said two plate portions, wherein said first deformation prevention piece portion is received in a second notch, formed below said other plate portion, to support part of said other plate portion from a lower side thereof, and said second deformation prevention piece portion is received in a space, disposed outwardly of said stepped portion, and a first notch, formed below said one plate portion, to support part of said one plate portion from a lower side thereof over an area of an L-shaped horizontal cross-section, to preventing said two plate portions from being deformed away from each other when the wire is press-fitted into said press-connecting blade.

2. A press-connecting terminal as claimed in claim 1, wherein said press-connecting blade includes a pair of cutting blades having an adjustable gap defined therebetween.

* * * * *